US006718968B2

(12) United States Patent
Cooley et al.

(10) Patent No.: US 6,718,968 B2
(45) Date of Patent: Apr. 13, 2004

(54) ENCLOSURE FOR AN INFRARED HEATER

(75) Inventors: Robert S. Cooley, Oconomowoc, WI (US); Jill M. Szczech, Milwaukee, WI (US); Gary A. Smith, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 152 days.

(21) Appl. No.: 10/021,593

(22) Filed: Dec. 6, 2001

(65) Prior Publication Data

US 2003/0108841 A1 Jun. 12, 2003

(51) Int. Cl.[7] ..... F24H 3/02

(52) U.S. Cl. ..... 126/110 C; 126/110 B; 126/110 D; 431/354; 431/350

(58) Field of Search ..... 126/110 C, 110 A, 126/100 D, 110 R, 91 R, 91 A, 110 B; 431/350, 351, 353, 354, 343

(56) References Cited

U.S. PATENT DOCUMENTS 2,044,715 A * 6/1936 Bluemel ..... 125/110 C
3,556,700 A * 1/1971 Jackson et al. ..... 431/182
4,595,355 A * 6/1986 Garrelfs et al. ..... 431/183
4,651,711 A * 3/1987 Velie ..... 126/110 C
4,978,293 A * 12/1990 Ryno ..... 431/351
5,090,897 A * 2/1992 Christenson ..... 431/183
5,441,405 A * 8/1995 Bedford et al. ..... 126/110 C
5,628,303 A * 5/1997 Ahmady et al. ..... 126/91 A
6,244,855 B1 * 6/2001 Turk et al. ..... 431/351

FOREIGN PATENT DOCUMENTS

DE 36 44 337 A1 * 7/1988 ..... F24H/3/12

* cited by examiner

*Primary Examiner*—Josiah Cocks
(74) *Attorney, Agent, or Firm*—Wood, Phillips, Katz, Clark & Mortimer

(57) ABSTRACT

A burner and fan enclosure for an infrared heater includes a low pressure housing 10 with an internal high pressure housing 24. A centrifugal fan 39 is located within the low pressure housing 10 and provides combustion air to the high pressure housing 24. Removable side panels 20,22 for the low pressure housing 10 may be removed for servicing and/or adjustment of the unit without affecting combustion characteristics allowing the unit to be adjusted while in operation.

18 Claims, 5 Drawing Sheets

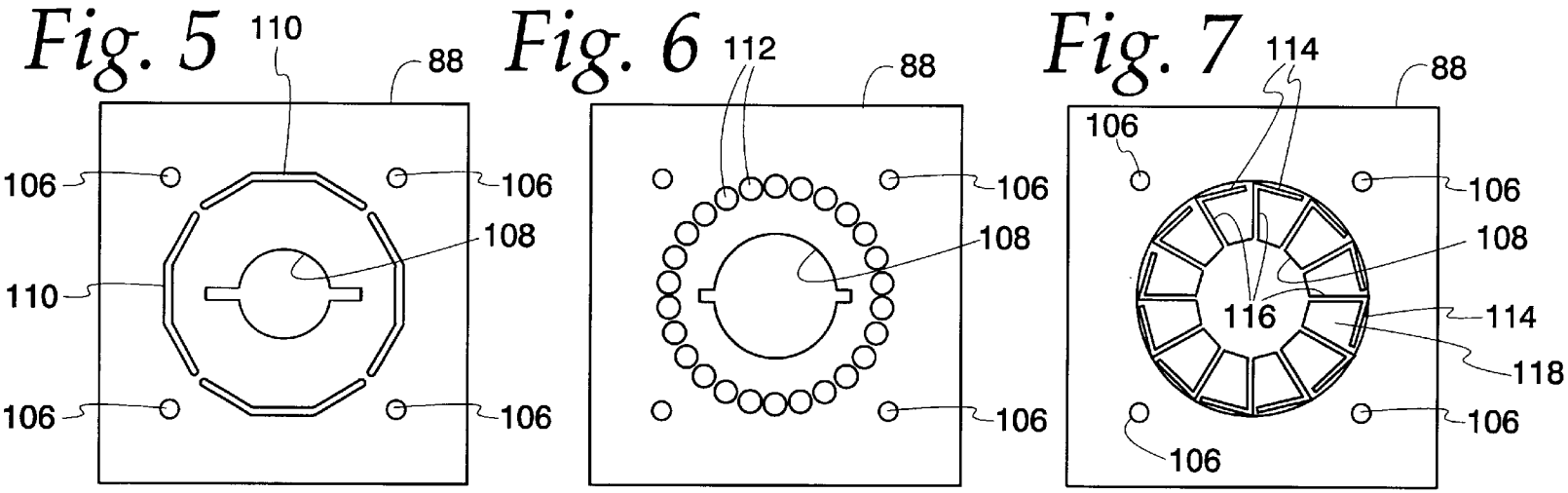
Fig. 5
Fig. 6
Fig. 7
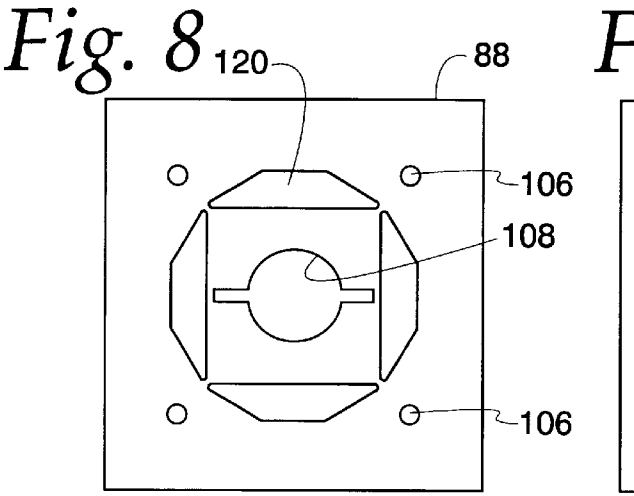
Fig. 8
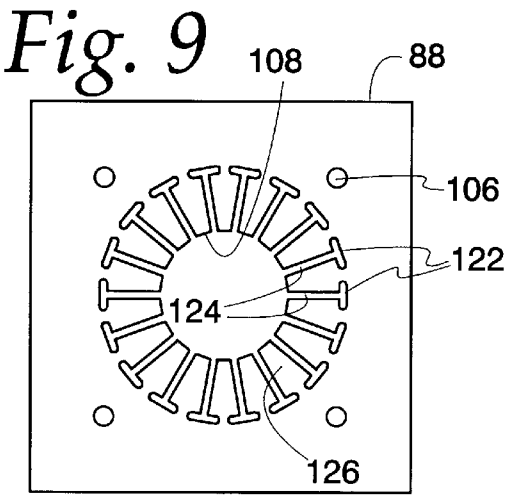
Fig. 9
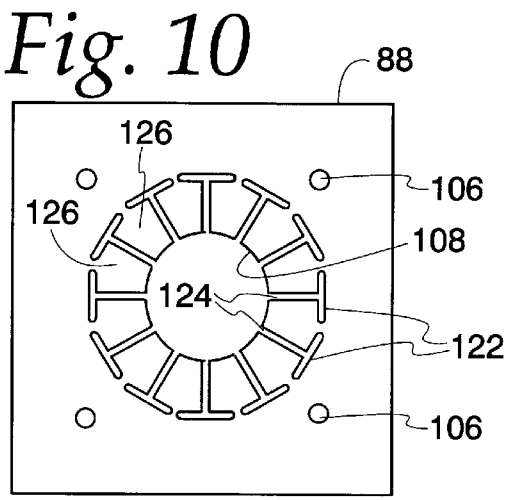
Fig. 10

ENCLOSURE FOR AN INFRARED HEATER

FIELD OF THE INVENTION

This invention relates to infrared heaters such as employed to heat large spaces such as garages, warehouses, and the like from an overhead location.

BACKGROUND OF THE INVENTION

Many large spaces are heated by so-called unit heaters. A unit heater is one that is self-contained in that a single unit includes a burner, typically the controls therefor, and some sort of heat exchange device for rejecting heat from the gases of combustion generated by the burner to the surrounding environment. One type of unit heater causes the hot gas of combustion to be passed through an elongated tube or the like before being expelled from the structure in which the heater is mounted. While some of the heat rejected to the environment is by means of conduction or convection to the air in which the tube is located, the primary means of heat rejection is by infrared radiation from the exterior surface of the tube.

In the usual case, such infrared heaters are mounted at an elevated location in the structure that they are intended to heat, frequently being in the range of 10–20 feet above the floor of the structure. Reflectors may be employed to direct infrared radiation downwardly toward the floor.

Because of the size of infrared heaters as well as the fact that they are mounted at a considerable distance above the floor, installing the heater and adjusting it for proper operation can be cumbersome tasks. In some cases, adjustment of the heaters is made difficult by parts of the structure in which the unit heater is mounted. For example, if a heater is mounted near a wall, access to the burner enclosure may be impeded by the wall.

Furthermore, many such infrared heaters are incapable of being adjusted properly during operation thereof. In some of these heaters, access to the controls can be achieved only by opening the burner enclosure which, in turn, may alter the characteristics of the incoming combustion air stream while the enclosure is open. Consequently, after the adjustment has been made, and the enclosure reclosed, the resulting change in combustion air patterns may alter operation of the heater to the point where it is not in proper adjustment. As a consequence, it may be necessary to open and close and reopen and close the enclosure for the burner during the adjusting process to repeatedly make adjustments until an adjustment that works properly with the enclosure closed is found by trial and error.

The present invention is directed to overcoming one or more of the above problems.

SUMMARY OF THE INVENTION

It is, therefore, the principal object of the invention to provide a new and improved infrared heater. More specifically, it is an object of the invention to provide such an infrared heater than may be easily installed and serviced, including adjustments, and which is of economical construction.

In one embodiment of the invention, there is provided a burner and fan enclosure for an infrared heater which includes a generally rectangular low pressure housing having a top wall, a bottom wall, opposed side walls and spaced rectangular panels. An air inlet is located in one of the walls and a burner outlet is located in one of the walls. A high pressure housing is located within the low pressure housing and has a side aligned with the burner outlet. An elongated burner tube is located within the high pressure housing and has opposed ends. One end of the burner tube extends through the burner outlet. A turbulator plate has plural openings therein arranged about a generally central opening and is located at or integral with the side wall having the burner outlet with the generally central opening receiving and supporting one end of the burner tube. A fuel manifold is also located within the high pressure housing adjacent the other end of the burner tube and a fuel orifice is in fluid communication with the manifold and aligned with the other end of the burner tube for directing fuel thereinto. A fan is disposed within the low pressure housing and is in fluid communication with the interior thereof. A gas control valve is located within the low pressure housing and has an outlet connected to the manifold.

As a consequence of this construction, when the low pressure housing is open to achieve access to the gas valve for adjustment purposes, the air stream to the burner within the high pressure housing is unchanged, allowing adjustment of the system during operation to avoid repetitive, trial and error adjustments.

According to another aspect of the invention, there is provided a low pressure housing, a burner outlet and high pressure housing as before. Also provided is a burner tube within the high pressure housing having one end extending toward the burner outlet. A fuel manifold is also located within the high pressure housing along with a fuel orifice in communication with the manifold and aligned with the burner tube for directing fuel thereinto. A gas control valve is disposed within the low pressure housing and is accessible through either of two removal side panels forming part of the low pressure housing and a rotary union is provided to interconnect the control valve outlet and the manifold.

This facet of the invention allows the gas valve, during installation, be twisted to face either of the side panels of the low pressure housing so that access may be achieved therethrough on either side of the enclosure. Consequently, a wall or other structure blocking access to one side panel can be avoided simply by rotating the gas valve within the housing at the time of installation so that its control parts are facing the opposite side panel which may be free from obstruction.

A preferred embodiment contemplates that there be two spaced, downwardly extending flanges on the top wall extending between the side walls of the low pressure housing and that there be two generally Z-shaped flanges on each of the side walls of the low pressure housing extending between the top and bottom walls. The side panels include reentrant flanges on the tops and sides thereof and the low pressure housing further includes at least one hook-like element at or near the bottom wall of the low pressure housing adjacent each side panel. Thus, the side panels may be easily fitted to the low pressure housing and removed therefrom. During an adjustment process, a side panel that has been removed may be suspended by the hook-like element, thereby providing easy access to the same when reinstallation of the side panel is required at the completion of the adjustment process.

In one embodiment of the invention employing an apertured turbulator plate, there are plural openings about a central opening. Preferably, the plural openings are apertures in the turbulator plate.

In one embodiment of the invention, turbulating vanes are located in the apertures.

In addition, the plural openings may be located radially outward of the central opening and have respective slots extending to the central opening. Portions of the turbulator plate between the slots are twisted on the turbulator plate to define the vanes between adjacent slots.

Other objects and advantages will become apparent from the following specification taken in connection with the accompanying drawings.

DESCRIPTION OF THE DRAWINGS

FIGS. 5–10, inclusive, illustrate different embodiments of turbulator plates that may be utilized in the invention;

DESCRIPTION OF THE PREFERRED EMBODIMENT

Figure 1:
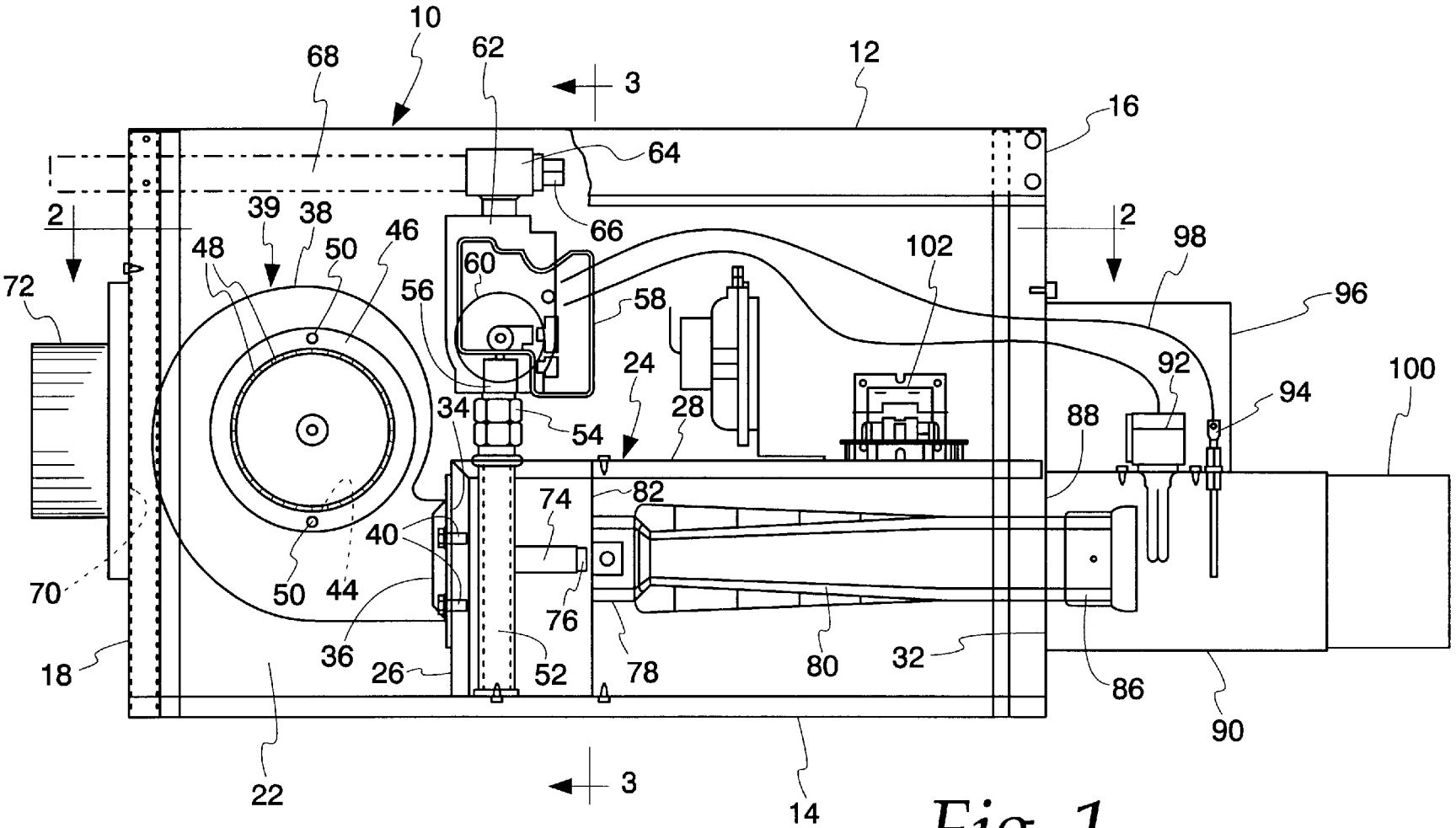
FIG. 1 is a side elevation of the enclosure with parts shown in section, parts broken away and with a removable side panel removed for clarity.

An exemplary embodiment of a burner and fan enclosure made according to the invention is illustrated in the drawings and with reference to FIGS. 1–4, inclusive, is seen to include a generally rectangular, low pressure housing, generally designated 10. The same includes a top wall 12, a bottom wall 14, and opposed, spaced side walls 16 and 18. The remaining sides of the housing 10 are open but are normally closed by two removable side panels, 20 and 22.

Figure 2:
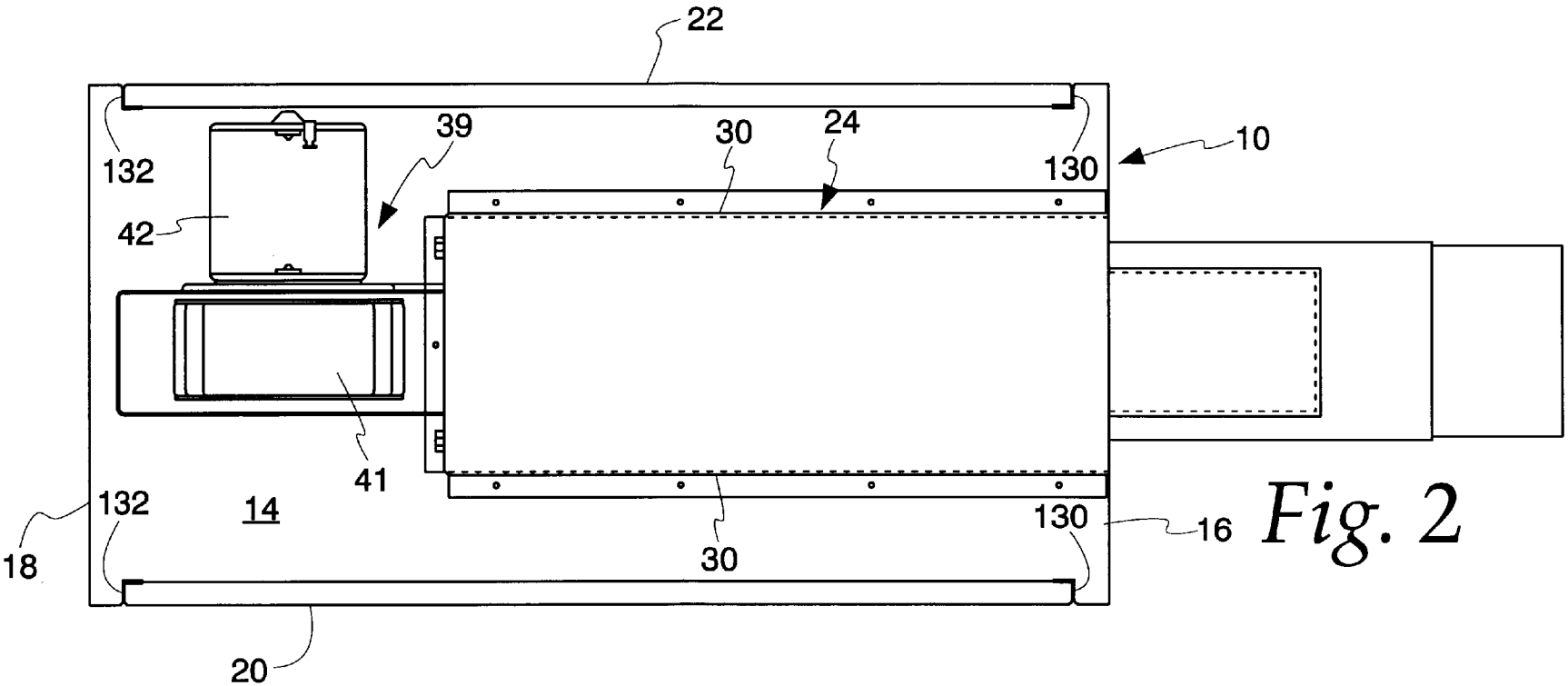
FIG. 2 is a horizontal sectional view taken approximately along the line 2—2 in FIG. 1.

Within the low pressure housing 10, near the lower right-hand corner thereof as viewed in FIG. 1, is a high pressure housing, generally designated 24. The high pressure housing 24 is also in the form of a rectangular solid and includes an end 26, a top 28 and two spaced sides 30. The spaced sides 30 are located inwardly of the side panels 20,22 of the low pressure housing 10 as seen in FIG. 2 and the bottom of the high pressure housing 24 and right-hand side thereof, as viewed in FIG. 1, are formed by parts of the bottom wall 14 and the side wall 16.

The high pressure housing 24, at its right-hand side as viewed in FIG. 1, aligns with an opening 32 in the side wall 16 of the high pressure housing 10. The end 26 includes an opening 34 to which the discharge end 36 of a volute 38 for a centrifugal fan, generally designated 39, is mounted by suitable fasteners 40. Within the volute 38 is a rotor 41 of the centrifugal fan 39 driven by an electrical motor 42 (FIG. 2). The volute 38 also includes a generally central side opening 44 which is closed by a removable flow restriction plate 46 having a plurality of apertures 48. The flow restriction plate 46 is removable and interchangeable with other flow restriction plates and to this end is secured to the volute 38 by means of threaded fasteners 50.

The centrifugal fan 39 is wholly within the low pressure housing 10 and discharges through the discharge end 36 of the volute 38 into the interior of the high pressure housing 24 in the vicinity of a vertically oriented fuel manifold 52 located within the high pressure housing 24 which extends partially through the top 28 thereof to a conventional rotary union 54.

The manifold 52 and rotary union 54 are aligned with each other and with the outlet 56 of a gas control valve 58 within the low pressure housing to which the union 54 is connected. The gas control valve 58 is conventional and includes a flow adjustment knob 60 and other flow control components typically associated with gas control valves. The gas control valve 58 also has an upper inlet 62 which is shown as being connected to a conventional tee 64 having one end blocked with a plug 66 and the other end connected to a gas supply pipe 68 which extends through an opening (not shown) in the side wall 18 near the upper end thereof.

The purpose of the foregoing construction is as follows. It will be recalled the side panels 20 and 22 are both removable, to allow access to the interior of the low pressure housing 10. Prior to connection of the gas valve 58 to the supply pipe 68, the valve 58 may be rotated about the union 54 to have its control side 60 face either the removable panel 20 or the removable panel 22. The choice will depend upon the location of installation of the infrared heater, and more specifically, which of the two removable side panels 20,22 is most accessible for installation and servicing purposes. For example, if access to the removable side panel 22 is partially or wholly blocked by part of the structure of the building in which the infrared heater is installed, the gas valve 58 will be rotated to the position illustrated in FIG. 1 with the control side 60 facing the panel 20. At this point, the connection to the supply line 68 will be established through the easy access provided by removing the removable side panel 20. Of course, if the access to the side panel 20 is made difficult, then the gas valve 58 will be rotated 180° from the position shown in FIG. 1 to allow easy access through the removable side panel 22 prior to installation. As a consequence of this feature of the invention, when servicing or adjustment of the system is required, easy access to the gas valve 58 is readily achieved.

The side wall 18 is provided with an opening 70 to which an air inlet fixture 72 is secured. Thus, air for combustion purposes may be drawn in the through the inlet fixture 72 and the opening 70 to the interior of the low pressure housing 12 by the centrifugal fan 39 at a flow rate that is determined by the flow restriction plate 46. In the usual case, the particular low restriction plate 46 selected will be dependent upon the capacity of the system and installed on the volute 38 prior to actual installation of the system within a building.

Returning now to the high pressure housing 24, the manifold 52 includes a fuel tube 74 terminating in a fuel orifice 76. The orifice 76 is aligned with one end 78 of a burner tube 80 which may be of conventional construction. The end 78 of the burner tube 80 may be supported in the position illustrated in FIG. 1 by means of a bracket 82 or the like extending between the top 28 of the high pressure housing 24 and the bottom wall of the low pressure housing. Of course, the bracket 82 is located so that it will not obstruct the gas from the orifice 76. The bracket controls the primary air from the centrifugal fan entering the burner tube 80 at its end 78.

The burner tube has an opposite end 86 which extends toward and through the opening 32 in that part of the side wall 16 that is common to both the low pressure housing 10 and the high pressure housing 24. A turbulator plate 88 is secured about the opening 32 or is integral with side wall 16 for the dual purpose of supporting the end 86 of the burner tube 80 and for turbulating secondary air for the burner comprised by the burner tube 80. The secondary air is that which passes about the exterior of the burner tube 80 after being flowed into the high pressure housing 24 by the centrifugal fan.

The side wall 16 also mounts a connection tube 90 into which the end 86 of the burner tube 80 extends and which receives secondary air through the turbulator plate 88. Extending into the connection tube 90 are various control instrumentalities for the burner including, for example, an igniter 92 and a flame sensor or thermocouple 94. A secondary housing 96 may be secured to the side wall 16 to enclose those parts of the igniter 92 and the flame sensor 94 that are external to the connection tube 90 as well as wiring 98 employed for control purposes. An offset in the infrared radiation tube 100 is located on the end of the connection tube 90. This offset 100 accepts longer lengths of infrared radiation tube and is shown only fragmentarily in FIG. 1, it being ultimately connected to a flue or the like.

If desired, other control components including, for example, an electrical transformer 102, may be contained within the low pressure housing 10 and mounted on an external surface of the high pressure housing 24.

Turning now to FIGS. 5–10, inclusive, six possible configurations of the turbulator plate 88 are disclosed. Each may include four holes 106 located at the corners of a square by which threaded fasteners (not shown) or the like may secure the turbulator plate 88 in place about the opening 32. Each turbulator plate also includes a central opening 108 through which the burner tube end 86 extends. The central opening 108 also serves to abut the burner tube 80 and support the same at its end 86 in the position illustrated in FIG. 1. In some cases, rather than use a separate turbulator plate 88, a turbulator of the same configuration may be formed directly and integrally in the wall 16.

Surrounding the central opening 108 of the turbulator plate illustrated in FIG. 5 is a series of four slots 110 through which secondary air may pass as noted previously. The slots 110 are elongated and each is made up of three straight line segments which define a slot that is concave in the direction on the central opening 108.

The embodiment illustrated in FIG. 6 omits the slots 110 in favor of a series of circular openings 112, the number of which will vary, arranged in a circular array about the central opening 108 for the same purpose.

In the embodiment illustrated in FIG. 7, a series of generally tangentially oriented slots 114 are located about the central opening 108 radially outwardly thereof. At one end of each of the slots 114, a radial slot 116 extends between the tangential slots 114 and the central opening 108 to define a series of inwardly directed tabs 118. The tabs 118 may be twisted out of the plane of the turbulator plate 88 to form vanes to cause a swirling of the secondary air as it exits the high pressure housing 24 and enters the connection tube 90.

The embodiment of FIG. 8 includes four trapezoidal-shaped openings radially outward of the central opening 108 in an array that is in the shape of a regular polygon.

In FIGS. 9 and 10, a series of tangential slots 122 provide a plurality of openings about the central opening 108 and are located radially outward thereof. Radially extending slots 124 extend between the centers of the tangential slots 122 and the central opening 108 and again define a series of tabs 126 which may be twisted from the plane of the turbulator plate 88 to define vanes similar in purpose to the vanes defined by the tabs 118 in the embodiment illustrated in FIG. 7. The principal difference between the embodiment shown in FIGS. 9 and 10 is that the tabs 126 in the embodiment of FIG. 9 have a greater radial length and a lesser circumferential width than those in the embodiment of FIG. 10.

In general, it has been found that turbulator plates of the form illustrated in FIGS. 5, 6 and 8 are preferred for cost purposes. Because the same do not include vanes which require a bending operation to be formed, these embodiments may be made more economically than the vane containing embodiments shown in FIGS. 7, 9 and 10. However, where good swirling of the secondary air is required for increased efficiency of combustion, or for reduced $NO_x$ emissions it may be desirable to employ turbulator plates having vanes such as those illustrated in FIGS. 7, 9 and 10.

Figure 4:
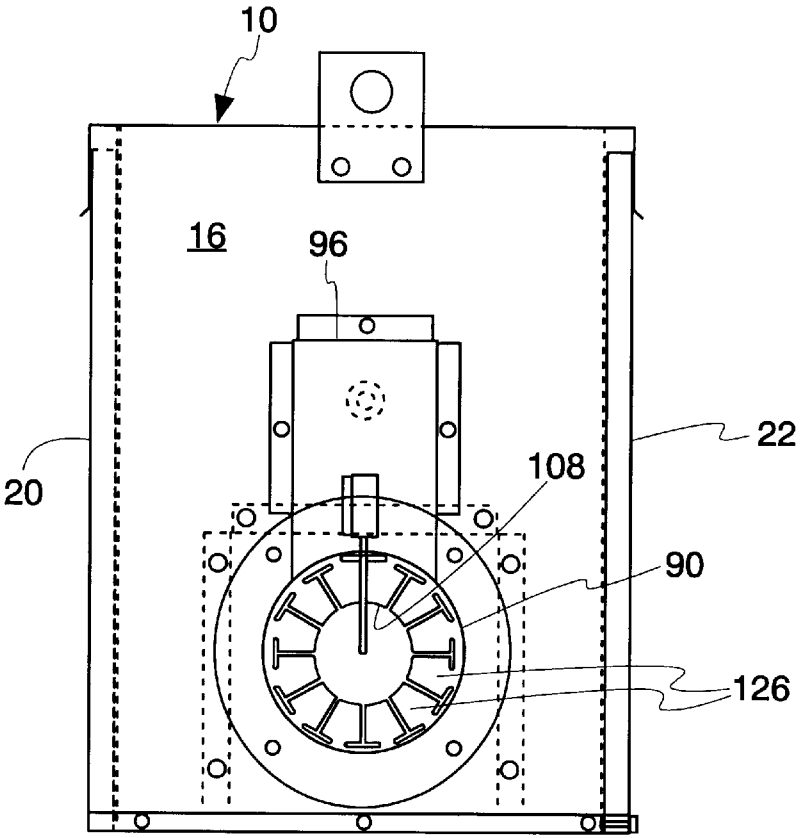
FIG. 4 is an end elevation taken from the right of FIG. 1.
Figure 3:
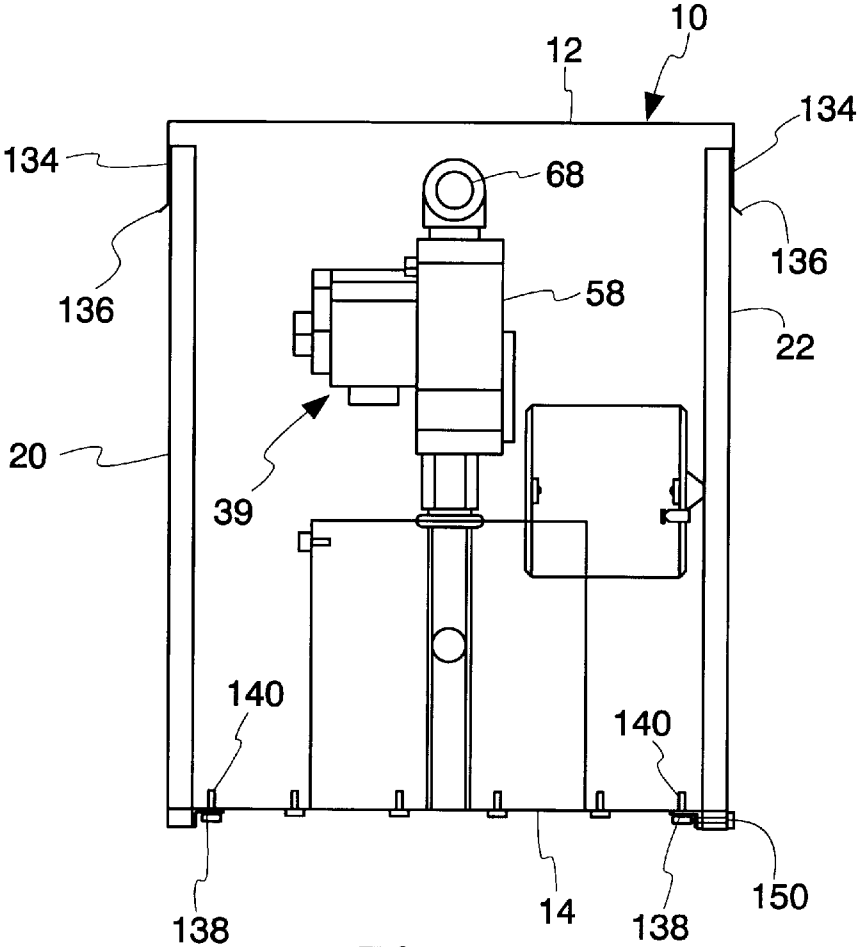
FIG. 3 is a vertical section taken approximately along the line 3—3 in FIG. 1.

Turning now to the removable side panels 20 and 22 and referring to FIGS. 1 and 2, it will be seen that the low pressure housing, and specifically, both edges of the side wall 16, include Z-shaped flanges 130 extending between the top and bottom walls 12 and 14. The side wall 18 includes similar Z-shaped flanges 132 that also extend, on both edges thereof, from top to bottom of the low pressure housing 22. The Z-shaped flanges 130 face the Z-shaped flanges 132. As can be seen in FIGS. 3 and 4, the top wall 12 has, on both sides thereof, depending, plain flanges 134 that terminate in out turned noses 136.

The bottom wall 14 has an L-shaped bend 138.

As can be ascertained from FIGS. 3, 4, 11 and 12, each of removable side panels 20,22, about its top, includes a reentrant flange 144 that extends the length of the top as well as reentrant flanges 146 on both sides that extend vertically between the tops and bottoms of the panels.

Figure 12:
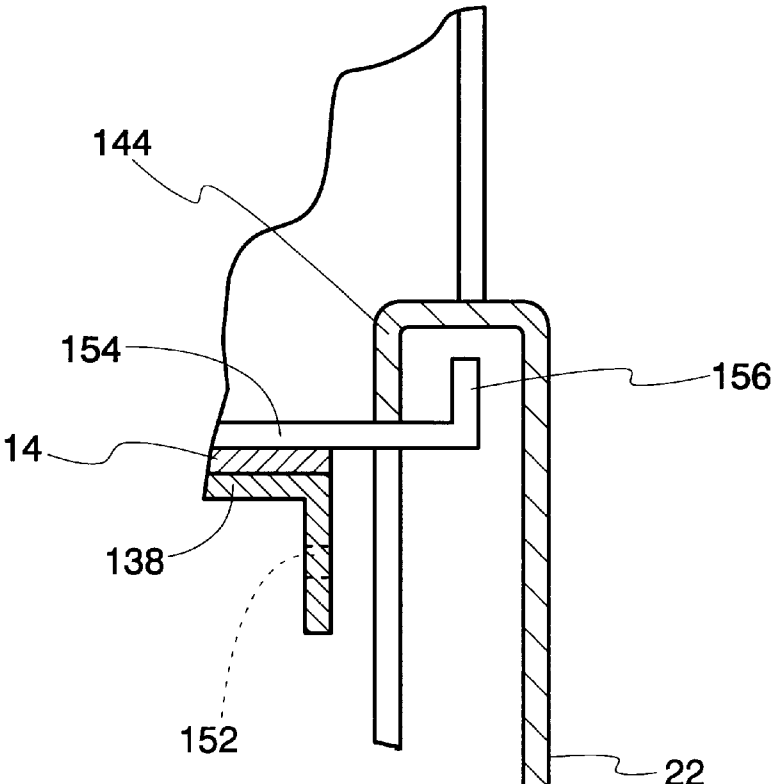
FIG. 12 is a view similar to FIG. 11 but with the side panel removed from the housing and suspended by a hook mounted to the housing.
Figure 11:
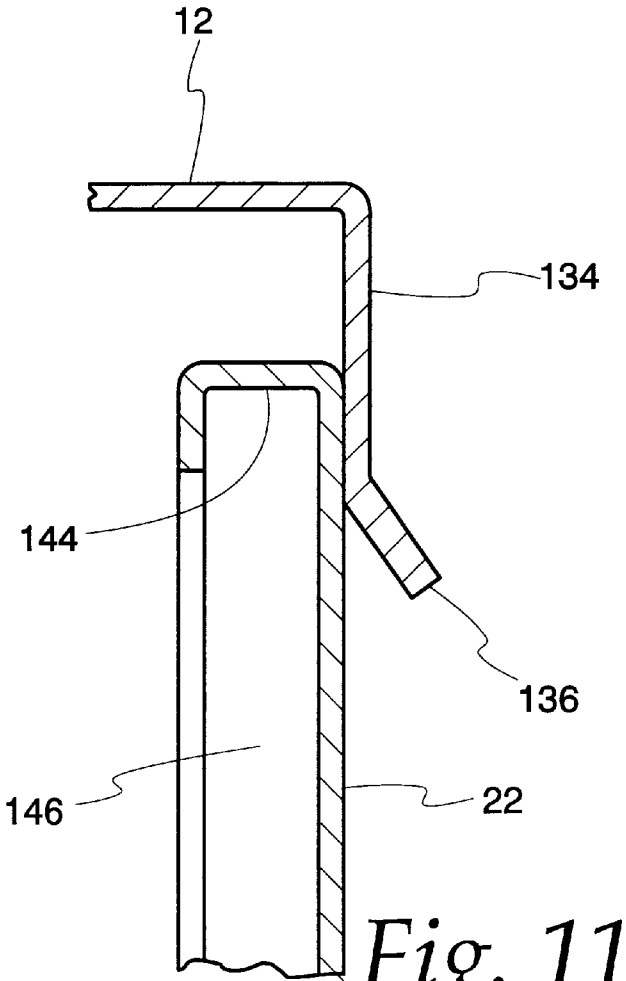
FIG. 11 is an enlarged, fragmentary, vertical section of a side panel and its relation to a top panel of a low pressure housing employed in the invention.

As seen in FIG. 3, the panels 20 and 22 are sized so that the reentrant flanges 144 may be inserted behind the plane flanges 134 on the top wall 12. The nose 136 facilitates such. The same may then be located at the position illustrated in FIG. 3 and a removable threaded fastener 150 threaded between the lower end of the panel 20,22 into the angle iron 138. FIG. 12 shows a fastener receiving opening 152 that may be used for the purpose.

To remove the panel 20,22, it is only necessary to remove the threaded fastener 150 and pivot the bottom of the panel 20,22 outwardly and lower the same. To provide a means of holding the panel 20,22 in an accessible position when the same is removed, as seen in FIG. 12, an angle iron or hook 154 having an upturned, outer end 156, may be secured by the threaded fasteners 140 to the upper side of the bottom wall 14. The upturned end 156 may serve as a stop for locating the bottom of the panel 20,22 when in the proper location and may also serve as a hook-like support for the panel 20,22 when the same is moved out of the position illustrated in FIG. 3 with the projection 156 entering the reentrant flange 144. Thus, servicing of the unit, particularly when the same is installed in an elevated position, is facilitated because a ladder having a shelf is not required nor is it required to descend the ladder to the set the removed panel 20,22 on the floor of the building.

It will therefore be appreciated that a burner and fan enclosure made according to the invention provides a number of advantageous features. For one, access to the interior of the housing is readily obtained by reason of the use of two, opposite, removable side panels 20,22. Furthermore, upon installation, the gas valve 58 may be oriented towards the removable side panel 20,22 that is to be used for access by rotation about the rotary union 54. Because a rotary union is involved, it is not necessary to overtighten threaded connections between the valve and conduits that might cause damage to the housing of the valve 58 to properly locate the valve 58. Similarly, undertightening to position the valve which could result in leaks is avoided as well.

Proper installation of the removable side panels 20,22 is facilitated by the fact that the reentrant flanges 144 on the panels 20,22 nest against the Z-shaped flanges 130,132 on the side walls 16 and 18 and tuck under the plain flange 134 on the top 12 to provide a gross seal for the low pressure housing at the removable panels. If desired, gasketing material to provide sealing could be employed at these interfaces.

The use of both a high pressure and a low pressure housing allow adjustment of the apparatus while in operation. Specifically, because the low pressure housing 10 is in fluid communication with the atmosphere through the inlet fixture 72 and the opening 70, removal of the removable side panels 20,22, does not alter the interior pressure within the enclosure causing a difference in operation as a result of changes in flow characteristics. Thus, easy adjustment of the system while operating is obtained without the need for a trial and error procedure in obtaining the proper adjustment as would be the case in other systems. That is to say, because the burner components are contained within the high pressure housing 24, they are always subject to the discharge pressure of the centrifugal fan during operation and that pressure will not change whether the low pressure housing 10 be opened or closed.

The unique means mounting the end 86 of the burner tube 80 by the turbulator plate 88 minimize cost and components in that the turbulator plate performs the dual function of providing turbulation of secondary air and supporting the end 86 of the burner tube 80. Consequently, an easy to install, easy to service and economical construction is provided.

What is claimed is:

1. A burner and fan enclosure for an infrared heater comprising:

a generally rectangular low pressure housing having a top wall, a bottom wall, opposed side walls and spaced removable, rectangular side panels extending between said top, bottom and side walls;

an air inlet in one of said side walls;

a burner outlet in the other of said side walls;

a high pressure housing within said low pressure housing and having a side aligned with said burner outlet;

an elongated burner tube within said high pressure housing and having opposed ends, one end extending through said burner outlet;

a turbulator having plural openings therein arranged about a generally central opening, said turbulator being located at or integral with said other side wall with said generally central opening receiving and supporting one end of said burner tube;

a generally vertical fuel manifold within said high pressure housing adjacent the other end of said burner tube;

a fuel orifice in fluid communication with said manifold and aligned with said other end of said burner tube for directing fuel thereinto;

a centrifugal fan within said low pressure housing and having a volute with a generally central inlet in fluid communication with the interior of said low pressure housing and a discharge outlet mounted to said high pressure housing and in fluid communication with the interior thereof in the vicinity of said manifold and upstream of said orifice;

a gas control valve within said low pressure housing and having an outlet aligned with said manifold;

a rotary union interconnecting said control valve outlet and said manifold;

said low pressure housing having side panel flanges on said top and side walls in or against which said side panels may nest or abut; and a lock on each side panel near a lower end thereof for removably locking the respective side panel to the low pressure housing.

2. The enclosure of claim 1 further including a connection tube for connection to a radiation tube affixed to said another side wall about said turbulator plate.

3. The enclosure of claim 2 wherein said burner tube extends into said connection tube.

4. The enclosure of claim 2 further including a secondary housing secured to said side wall enclosing at least one burner control device mounted on said connection tube and extending into the same.

5. The enclosure of claim 1 wherein said volute, about said central inlet, includes a removable, interchangeable flow restrictor.

6. The enclosure of claim 1 wherein said flanges include two, spaced, downwardly extending flanges on said top wall extending between said side walls and two generally Z-shaped flanges on each of said side walls extending between said top or bottom walls.

7. The enclosure of claim 6 further including reentrant flanges on the top and sides of each said side panels, said enclosure further in at least one hook-like element near or at the bottom wall of said low pressure housing adjacent each said side panel and adapted to support the respective side panel by its top reentrant flange.

8. A burner and fan enclosure for an infrared heater comprising:

a generally rectangular low pressure housing having a top wall, a bottom wall, opposed side walls and spaced rectangular side panels;

an air inlet in one of said walls;

a burner outlet in one of said walls;

a high pressure housing within said low pressure housing and having a side aligned with said burner outlet;

an elongated burner tube within said high pressure housing and having opposed ends, one end extending toward said burner outlet;

a turbulator having plural openings therein arranged about a generally central opening, said turbulator being located at or integral with one of said walls with said generally central opening receiving and supporting one end of said burner tube;

a fuel manifold within said high pressure housing adjacent the other end of said burner tube;

a fuel orifice in fluid communication with said manifold and aligned with said other end of said burner tube for directing fuel thereinto;

a fan within said low pressure housing and having a discharge outlet in fluid communication with the interior of said high pressure housing; and a gas control valve within said low pressure housing and having an outlet connected to said manifold.

9. The enclosure of claim 8 further including a connection tube for connection to side wall about said turbulator.

10. The enclosure of claim 9 wherein said burner tube extends into said connection tube.

11. The enclosure of claim 9 further including a secondary housing secured to said side wall enclosing at least one burner control device mounted on said connection tube and extending into the same.

12. A burner and fan enclosure for an infrared heater comprising:

a generally rectangular low pressure housing having a top wall, a bottom wall, opposed side walls and spaced removable, rectangular side panels extending between said top, bottom and side walls;

a burner outlet in one of said walls;

a high pressure housing within said low pressure housing and having a side aligned with said burner outlet;

an elongated burner tube within said high pressure housing and having opposed ends, one end extending toward said burner outlet;

a fuel manifold within said high pressure housing adjacent the other end of said burner tube;

a fuel orifice in fluid communication with said manifold and aligned with said other end of said burner tube for directing fuel thereinto;

a centrifugal fan in fluid communication with the interior of said high pressure housing in the vicinity of said manifold and upstream of said orifice;

a gas control valve within said low pressure housing and accessible through either of said side panels and further having an outlet aligned with said manifold; and a rotary union interconnecting said control valve outlet and said manifold.

13. The enclosure of claim 12 including two, spaced, downwardly extending flanges on said top wall extending between said side walls and two generally Z-shaped flanges on each of said side walls extending between said top or bottom walls.

14. The enclosure of claim 13 further including reentrant flanges on the top and sides of each said side panels, said enclosure further including at least one hook-like element near or at the bottom wall of said low pressure housing adjacent each said side panel and adapted to support the respective side panel by its top reentrant flange.

15. A burner and fan enclosure for an infrared heater comprising:

a generally rectangular low pressure housing having a top wall, a bottom wall, opposed side walls and spaced rectangular side panels extending between said top, bottom and side walls;

a burner outlet in one of said walls;

a high pressure housing within said low pressure housing and having a side aligned with said burner outlet;

an elongated burner tube within said high pressure housing and having opposed ends, one end extending through said burner outlet;

a turbulator plate having plural openings therein arranged about a generally central opening, said turbulator plate being located at or integral with one of said side walls with said generally central opening receiving and supporting one end of said burner tube;

a fuel manifold within said high pressure housing adjacent the other end of said burner tube;

a fuel orifice in fluid communication with said manifold and aligned with said other end of said burner tube for directing fuel thereinto;

a fan within said low pressure housing and in fluid communication with the interior of said high pressure housing in the vicinity of said manifold and upstream of said orifice;

a gas control valve within said low pressure housing and having an outlet connected to said manifold.

16. The enclosure of claim 15 wherein said plural openings are apertures in said turbulator plate.

17. The enclosure of claim 16 including turbulating vanes in said apertures.

18. The enclosure of claim 15 wherein said plural openings are located radially outward of said central opening and have respective slots extending to said central opening, portions of said turbulator plate between said slots being twisted on said turbulator plate to define vanes between adjacent slots.

* * * * *